United States Patent [19]

Bader

[11] Patent Number: 5,044,538

[45] Date of Patent: Sep. 3, 1991

[54] CARRYING STRAP

[76] Inventor: Daniel M. Bader, 2133 Hemlock Rd., Norristown, Pa. 19403

[21] Appl. No.: 559,006

[22] Filed: Jul. 27, 1990

[51] Int. Cl.[5] ..... A45F 3/14

[52] U.S. Cl. ..... 224/258; 224/250

[58] Field of Search ..... 224/150, 205, 250, 257, 224/258, 264; 294/157

[56] References Cited

U.S. PATENT DOCUMENTS

| | | | |
|---|---|---|---|
| 3,799,413 | 3/1974 | McBain | 224/264 |
| 3,884,403 | 5/1975 | Brewer | 224/257 X |
| 4,114,838 | 9/1978 | Knauf | 294/157 |
| 4,148,423 | 4/1979 | Schlacher | 224/258 |
| 4,261,493 | 4/1981 | Newman | 224/257 |
| 4,337,938 | 7/1982 | Rodriguez | 224/258 X |
| 4,470,528 | 9/1984 | Dyess | 224/257 |
| 4,760,944 | 8/1988 | Hughes | 224/205 |
| 4,804,025 | 2/1989 | Bear | 224/258 X |

*Primary Examiner*—Renee S. Luebke

*Attorney, Agent, or Firm*—Seidel, Gonda, Lavorgna & Monaco

[57] ABSTRACT

An article carrying strap has an elongated web of material with a first end. The first end has releasable fastening elements on one surface of the web for forming an openable and closable loop at the first end. The second end is disposed at an oblique angle to the longitudinal center line of the web and has releasable fastening elements on the surface of the web for forming an openable and closable loop at the second end. Each loop is adapted to receive a portion of an article to be carried.

9 Claims, 2 Drawing Sheets

FIG. 4
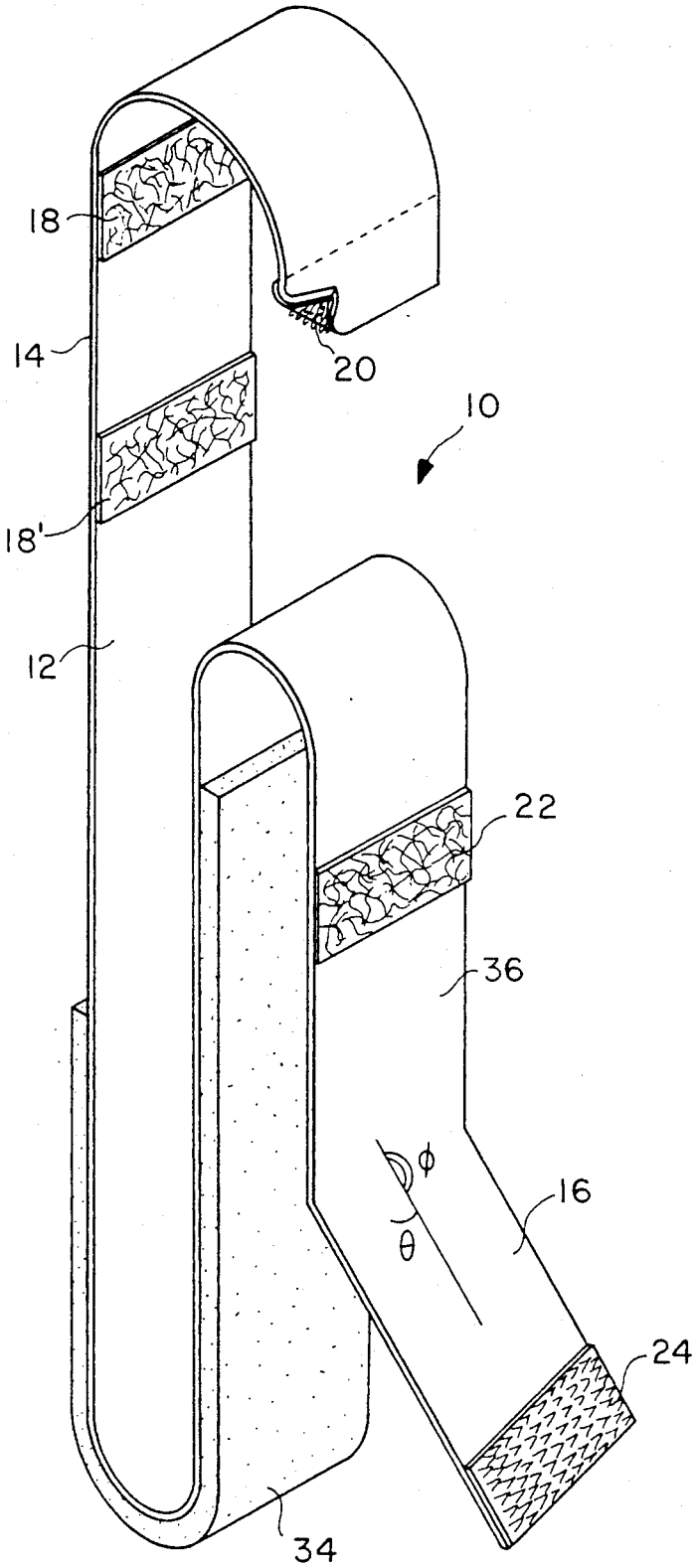
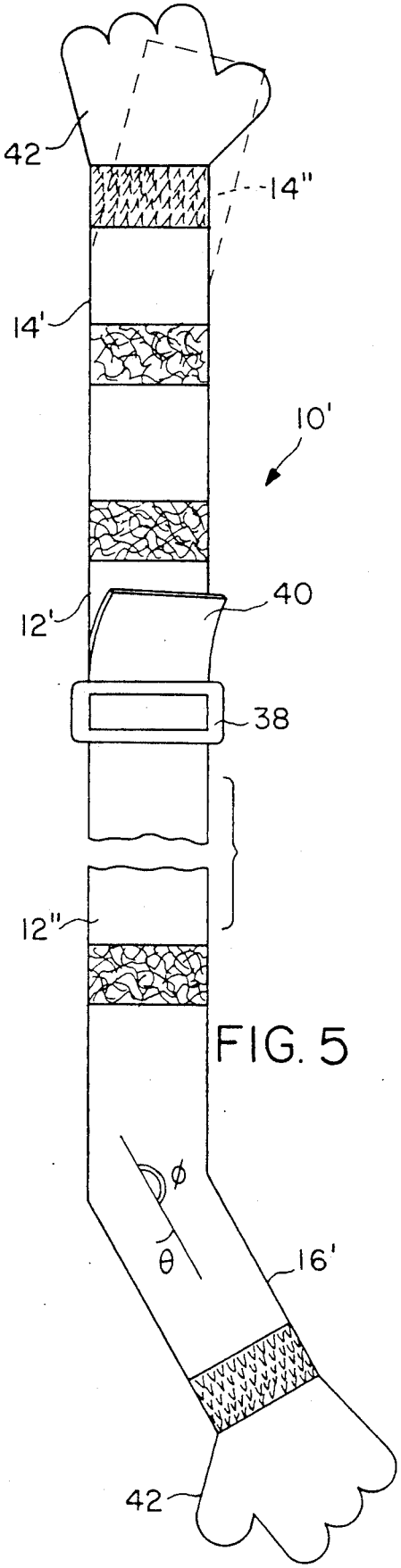
FIG. 5

CARRYING STRAP

FIELD OF THE INVENTION

The present invention relates to article carrying straps which facilitate carrying articles by a user, such as by the hand, over the shoulder, around the neck, and the like.

BACKGROUND OF THE INVENTION

Article carrying straps are known. See, for example, U.S. Pat. Nos. 3,884,403, 4,114,838, 4,261,493, 4,760,944 and 4,804,025. Known carrying straps enable the user to carry a usually-unwieldy article by the hand, over the shoulder, around the neck, and so forth. Most of the known straps, however, are relatively complex and require a number of different parts.

There is a need for a simple, easy to use and inexpensive to manufacture carrying strap with a minimum of parts which enables the user to carry articles preferably, although not necessarily, over the shoulder with a minimum of fuss. The present invention satisfies that need.

SUMMARY OF THE INVENTION

The present invention is directed to an article carrying strap comprising an elongated web of material having a first end and a second end. The first end has releasable fastening means for forming an openable and closable loop at the first end. The second end is disposed at an oblique angle to the longitudinal center line of the web and has releasable fastening means for forming an openable and closable loop at said second end. Each said loop is adapted to receive a portion of an article to be carried.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4 illustrates a strap according to the present invention without reference to an article.

FIG. 5 illustrates features of alternate embodiments of the strap according to the present invention.

DESCRIPTION OF THE INVENTION

Figure 1:
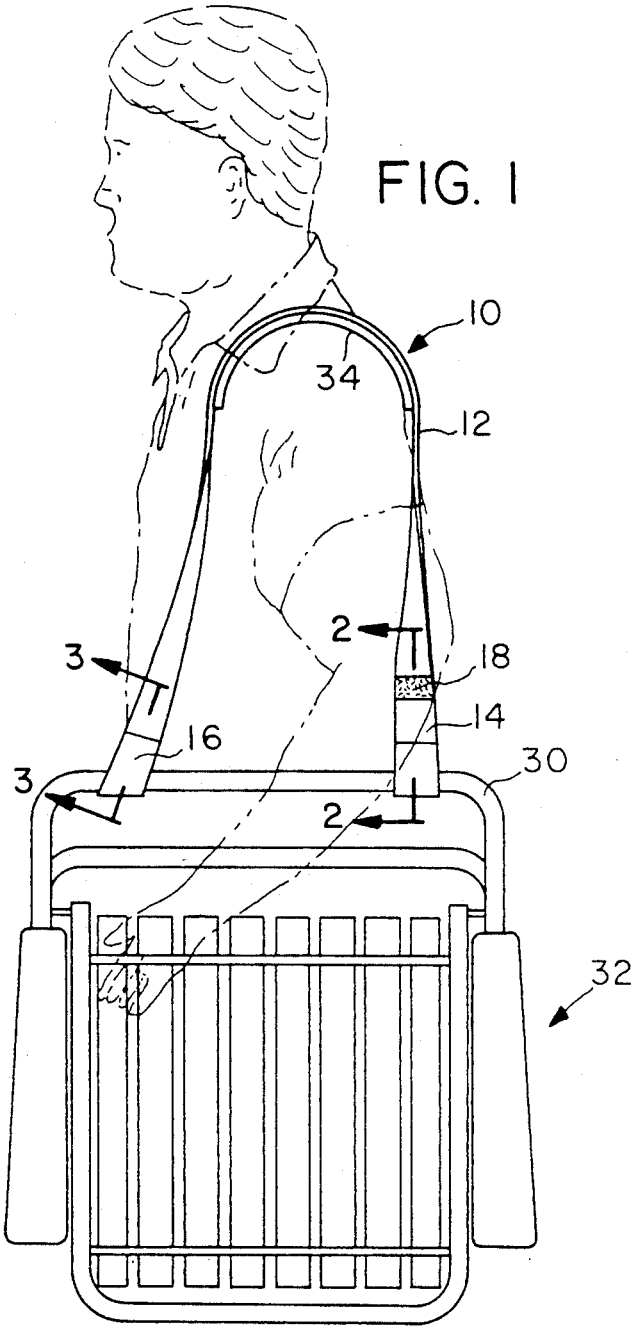
FIG. 1 illustrates a carrying strap according to the present invention, as it would be employed by a user to carry an article, such as a folding chair.

Referring now to the Figures, wherein like numerals indicate like elements, there is shown in FIG. 1 an article carrying strap 10 according to the present invention, as would be employed by a user to carry an article, for example, a folding chair. (Although the invention is illustrated as carrying a folding chair, it should be understood that the strap of the invention is not so limited, and may be used to carry any desired article). In FIG. 1, the strap 10 is shown suspended from the shoulder of a user, but it should be understood that the strap 10 may be carried in any manner comfortable to the user, such as around the neck, or by the hand. The way in which the strap is used to carry articles, and the articles carried by the strap, are illustrative only and are not crucial to the invention.

Referring now to FIGS. 1–4, strap 10 comprises an elongated web 12 of material, the web having a first end 14 and a second end 16. Web 12 is preferably between about 2 to 2½ inches in width and between about 56 to 60 inches in length, but the precise dimensions are not critical. First end 14 is provided with fastening means 18 and 20. In the Figures, fastening means 18 and 20 are shown on one surface of web 12. However, fastening means 18 and 20 may be on either or both surfaces of web 12. Likewise, second end 16 is also provided with fastening means 22 and 24. Fastening means 18 and 22 are preferably the loop portions of hook-and-loop fastening elements commonly known as VELCRO (Trademark). Fastening elements 20 and 24 are preferably the hook portions of hook-and-loop VELCRO-type fasteners. Although VELCRO-type fasteners are preferred, any type of releasable fastening elements, such as snaps, buttons, and the like, may be used without departing from the invention.

Figure 2:
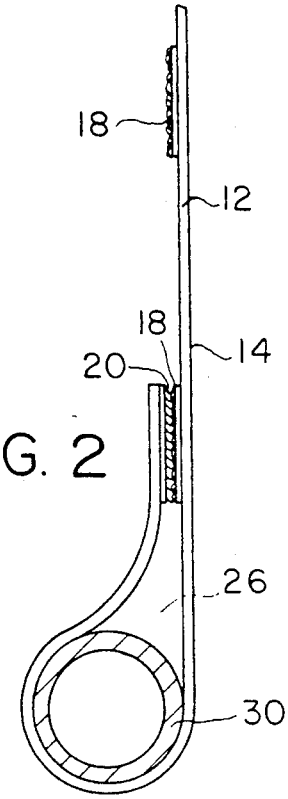
FIG. 2 is a sectional view of the first end of the carrying strap of FIG. 1, taken along the line 2—2 in FIG. 1.
Figure 3:
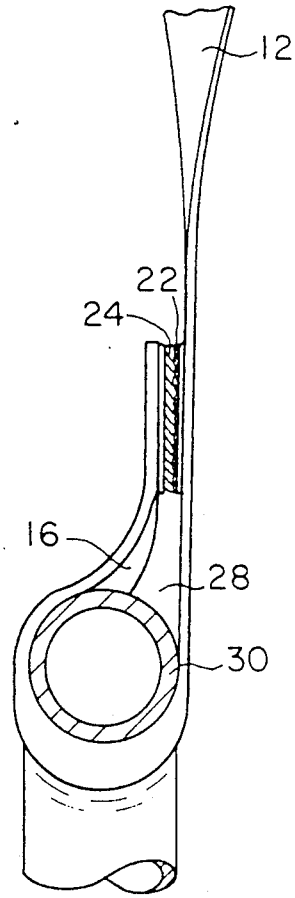
FIG. 3 is a sectional view of the strap of FIG. 1, taken along the lines 3—3 of FIG. 1.

As best seen in FIGS. 2 and 3, the hook and loop fastening elements at ends 14 and 16 of strap 10 cooperate to form openable and closable loops 26 and 28, respectively, for receiving a portion of an article to be carried and thereby securing it to strap 10. In the illustrated example, loops 26 and 28 receive a portion of the tubular frame 30 of a common type of folding chair 32. It is readily seen that loops 26 and 28 are formed by passing ends 14 and 16, respectively, around frame 30 and securing the mating halves of the fastening elements 18, 20 and 22, 24, respectively, together.

Preferably, a plurality of loop portions of VELCRO-type fasteners are provided at first end 14 of strap 10 inward of the extreme end of the strap. At the extreme end, the hook portion of a Velcro-type fastener is provided. By providing a plurality of loop fasteners at spaced locations transversely across web 12, the size of the opening formed by loop 26 can be conveniently adjusted. Thus, for example, more than one chair 32 could be carried by strap 10 by forming a larger loop simply by attaching hook portion 20 to loop portion 18' at first end 14. Any number of loop portions may be provided to enable a user to form loops of any desired sizes. Also, although not preferred, a continuous strip of loop portion may be used instead of individual loop portions 18 and 18'. It should also be understood that loop portions and hook portions are interchangeable, so that the loop portion can be located at the extreme end of the strap and a plurality of hook portions can be located at spaced locations on web 12, without departing from the scope of the invention.

In addition to forming loops of different sizes, the overall length of strap 10 can be increased or decreased by forming smaller or larger loops, respectively. Moreover, additional loop fastening portions 18 can be placed at selected locations along web 12 to enable strap 10 to be adjusted to any desired length.

If desired, a cushion means 34 may be provided on web 12 intermediate ends 14 and 16, to make strap 10 more comfortable to carry. However, cushion means 34 is optional, and is not crucial to the invention.

A particularly novel feature of the invention is that the second end 16 is disposed at an oblique angle $\theta$ with respect to the longitudinal center line 36 of strap 10. Angle $\theta$ is greater than 0° but less than 90° (and, consequently, complimentary angle $\phi$ is greater than 90° but less than 180°). Preferably, the angle $\theta$ is on the order of 30°, although the precise angle is not critical to the invention. By disposing second end 16 at an angle to the longitudinal center line of web 12, loop 28 will have an opening whose center line is also at an oblique angle with respect to the longitudinal center line of web 12. Thus, as best seen in FIG. 1, the center line of loop 16 will be generally parallel to the tubular frame 30 of chair 32 when the strap 10 is placed over the user's shoulder. This compensates for bunching of web 12 that would normally occur if second end 16 were not disposed at an angle to web 12. By compensating for such bunching, less stress is placed on loop 28, which means that loop 28 is more likely to remain fastened. In addition, the web 12 will retain its shape after prolonged use, since bunching is substantially eliminated.

If desired, both ends of strap 10 may be disposed at an oblique angle to the longitudinal center line of the web. Thus, as shown in FIG. 5, first end 14'' (shown in phantom) may be disposed at an oblique angle, as is end 16'. However, it is preferred to have only one end so disposed in order to easily enable the length of the strap to be adjusted at the non-oblique end, as explained above. Nevertheless, other provision may be made for adjusting the length of strap 10 if both ends are angled. For example, as shown in FIG. 5, strap 10' can be made of two web portions 12' and 12'', with one end of web portion 12', for example, being connected to the crossbar (not shown) of a conventional buckle 38 and one end 40 of web portion 12'' passing through buckle 38. Thus, the length of strap 10' can easily be adjusted by buckle 38 in well-known manner. Using this arrangement, either or both ends 14' and 16' can be disposed at an oblique angle.

Additional optional features of the invention are shown in FIG. 5. Strap 10' may include decorative means 42 at either or both ends. In FIG. 5, decorative means 42 are illustrated in the form of stylized hands, in keeping with the theme of strap 10'. Of course, it should be understood that decorative means 24 can have any desirable form, such as faces, feet, flowers, animals, and so forth, without departing from the invention.

In addition, if desired, graphic or printed matter may be applied to web 12, and web 12 may be of any desired color or colors. Web 12 may also have small items attached thereto, such as decorative appliques, or small pockets to carry change, keys and other small items.

Web 12 is preferably made of a woven fabric such as canvas, nylon and the like, but could also be made of flexible plastics, non-elastic rubber, and so forth.

The present invention may be embodied in other specific forms without departing from the spirit or essential attributes thereof and, accordingly, reference should be made to the appended claims, rather than to the foregoing specification, as indicating the scope of the invention.

I claim:

1. A one-piece carrying strap for an article, comprising an elongated web of material having a first end and a second end, the first end having releasable fastening means for forming an openable and closable loop integral and continuous with the web at said first end, the second end being disposed at an oblique angle to a longitudinal center line of the web and having releasable fastening means for forming an openable and closable loop integral and continuous with the web at said second end, each said loop being adapted to receive a portion of an article to be carried, the strap having a length defined by the approximate distance along the web between said loops, the releasable fastening means at the first end comprising a plurality of fastening elements for forming an openable and closable loop of a plurality of selectable sizes and simultaneously adjusting the length of the strap.

2. A strap according to claim 1, wherein said oblique angle is greater than 0° and less than 90°.

3. A strap according to claim 1, wherein the releasable fastening means comprises cooperating hook and loop fasteners.

4. A strap according to claim 1, further comprising cushioning means on said elongated web.

5. A strap according to claim 1, further comprising decorative means at at least one end.

6. A strap according to claim 5, wherein said decorative means symbolizes a hand.

7. A one-piece carrying strap for an article, comprising an elongated web of material having two ends, each end having releasable fastening means thereon for forming an openable and closable loop thereat, each loop being integral and continuous with the web, at least one end being disposed at an oblique angle to a longitudinal centerline of the web.

8. A strap according to claim 7, wherein each end is disposed at an oblique angle to the longitudinal centerline of the web.

9. A one-piece carrying strap for an article, comprising an elongated web of material having two ends, a plurality of cooperating releasable fastening means at each end at spaced locations along the web for forming an openable and closable loop of selectable opening dimensions integral and continuous with the web at each end thereof and for varying the distance between said loops along the web, one end of the web being disposed at an oblique angle to a longitudinal centerline of the web, each loop being adapted to receive a portion of an article to be carried by the strap, the web being dimensioned to be slung over a shoulder of a user for carrying an article.

* * * * *